US006010430A

United States Patent [19]

Mankovtiz

[11] Patent Number: 6,010,430

[45] **Date of Patent: *Jan. 4, 2000**

[54] EXERCISE APPARATUS FOR USE WITH CONVENTIONAL CHAIRS

[76] Inventor: Roy J. Mankovtiz, 18057 Medley Dr., Encino, Calif. 91316

[ * ] Notice: This patent is subject to a terminal disclaimer.

[21] Appl. No.: 09/130,859

[22] Filed: Aug. 7, 1998

Related U.S. Application Data

[60] Provisional application No. 60/055,436, Aug. 7, 1997.

[51] Int. Cl.[7] ..... A63B 21/00

[52] U.S. Cl. ..... 482/8; 482/121; 482/129; 482/130; 482/132

[58] Field of Search ..... 482/1–9, 900–902, 482/83, 79, 121, 130, 129, 132, 135

[56] References Cited

U.S. PATENT DOCUMENTS 5,580,337 12/1996 Habing et al. ..... 482/57
5,647,822 7/1997 Avganim ..... 482/57
5,685,804 11/1997 Whan-Tong et al. ..... 482/57
5,690,594 11/1997 Mankovitz ..... 482/121
5,738,612 4/1998 Tsuda ..... 482/57

*Primary Examiner*—Glenn E. Richman
*Attorney, Agent, or Firm*—Christie, Parker & Hale, LLP

[57] ABSTRACT

Exercise apparatus for attachment to a chair having a center support post. The apparatus has a foot support, wheels mounted on the respective ends of the foot support for rolling on a floor, and a resilient member that exerts resistance as the foot support is moved. One or more sensors are coupled to the wheels for monitoring a user's body functions during exercise. The sensors provide inputs to software in the user's computer that calculate the level of the user's exercise activity as the user is at work on his/her computer. The results are displayed on the computer's monitor.

7 Claims, 4 Drawing Sheets

Fig. 1

OFFICIZER SETUP

REMINDER INTERVAL _____ MIN

AGE _____ YRS WEIGHT _____ LBS

WORKOUT LEVEL: LO ____ MED ____ HIGH ____

RESISTANCE LEVEL:

LO (GRN) _____ MED (BLU) _____ HI (RED) _____

YOUR TARGET HEART RATE IS 140 BPS

Fig. 2

OFFICIZER REMINDER

DATE: 05/01/96 TIME: 10:30 AM

TIME TO DO 20 REPS

ENTER FINAL COUNTER VALUE _____

Fig. 3

OFFICIZER DAILY SUMMARY

TODAY, MAY 1, 1996, YOU HAVE PERFORMED 200 REPS AND BURNED 175 CALORIES

EXERCISE APPARATUS FOR USE WITH CONVENTIONAL CHAIRS

CROSS-REFERENCE TO RELATED APPLICATIONS

This application claims the benefit of provisional Application No. 60/055,436 filed Aug. 7, 1997.

The disclosure of application Ser. No. 08/441,940 filed May 16, 1995, which describes a product called Officizer, is incorporated fully herein by reference now U.S. Pat. No. 5,690,594.

SUMMARY OF THE INVENTION

In one aspect of the invenention exercise apparatus has wheels mounted on a foot support for rolling on a floor. A resilient member provides resistance e as a user rolls the foot support back and forth. A user's body functions are monitored during the exercise to display the user's exercise level on a computer monitor.

BRIEF DESCRIPTION OF THE INVENTION

The features of specific embodiments of the best mode contemplated of caarrying out the invention are illustrated in the drawings, in which:

FIGS. 1–3 are typical computer screens used in practicing the invention;

In any exercise, it is desirable to provide the user with monitoring and feedback information to encourage use. Modern exercise equipment incorporate computer electronics to monitor and display exercise progress as well as user parameters.

In the case of Officizer, where the user is likely to be an office worker using a PC while exercising, the idea is to use the PC for the monitoring and feedback tasks as follows. The user is provided with software designed to operate in a multi-tasking environment, such as Windows 95 or Mac. The software may be in the form a floppy, CD-ROM, or downloaded from a web site. Once loaded and run, the software presents the user with a setup screen as shown in FIG. 1.

As part of setup, the user indicated the time interval at which he/she is to be reminded to exercise during the work day, enter his age, weight and desired workout level. The user also specifies the resistance level being used in the Officizer apparatus. It is contemplated that the Officizer will be supplied with at least three sets of resilient, color coded members having different coefficients of elasticity. Given this information, the program calculates the maximum heart rate (based on age in a manner well known in the art), and determines and displays a target heart rate as a percent of maximum, where the percentage is based on the specified workout level.

Figure 4:
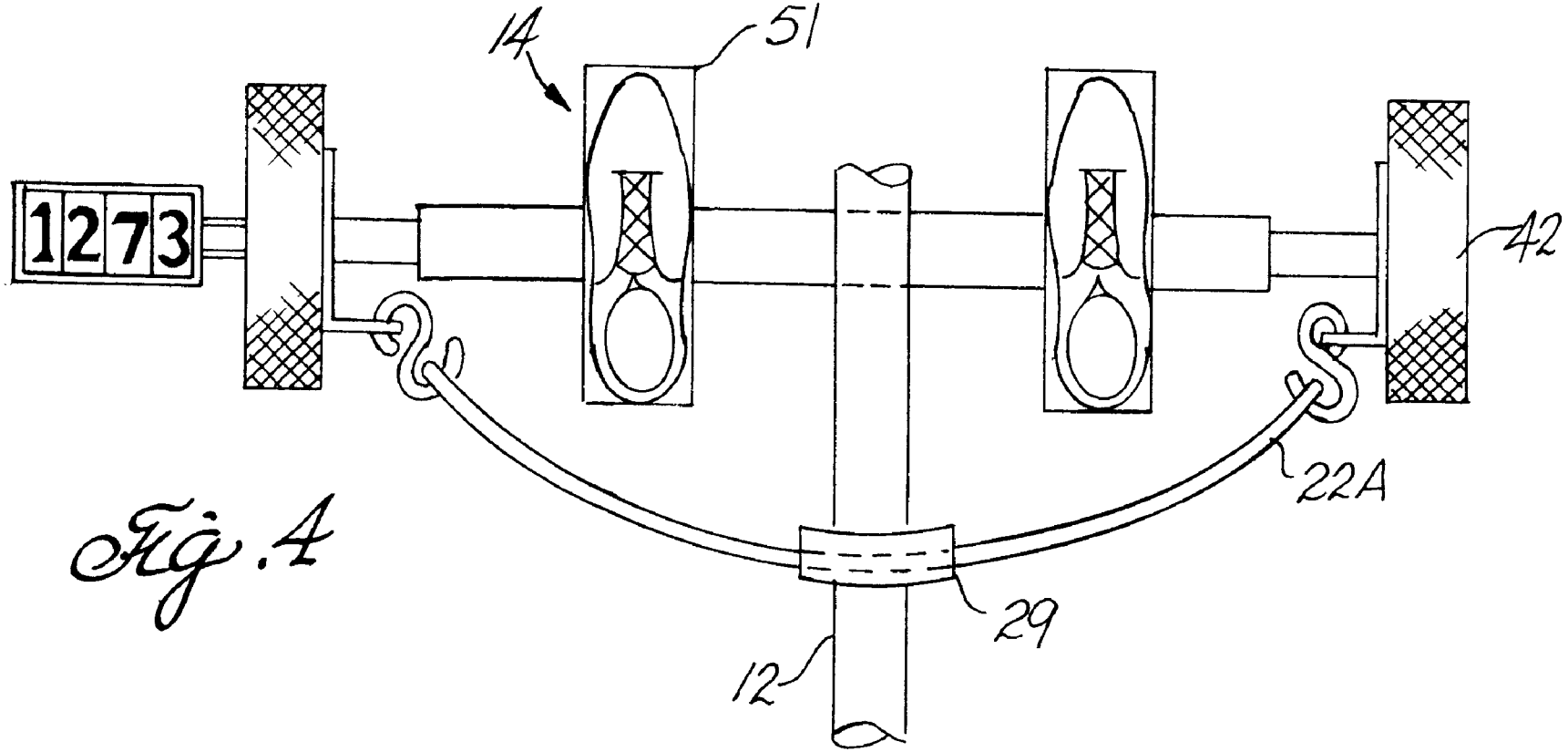
FIG. 4 is exercise apparatus equipped with a counter designed to carry out the invention.

After the program is set up, it operates in the background, and pops up a reminder screen as shown in FIG. 2 at the time intervals specified by the user. The reminder sets a number of reps determined by the workout level. As shown in FIG. 4, the Officizer apparatus is equipped with a counter attached to one wheel. The counter counts the number of revolutions of the wheel in the direction away from the chair. A ratchet is provided so that the retraction motion is not counted. The program includes algorithms that convert wheel rotations into linear distance, and which also calculate the force needed to extend the resilient members a given distance. The force vs. distance curves for these members is not a constant, and the program contains the data to accurately calculate total force expended. Using the user's weight, the program can also calculate the calories expended over time. As shown in FIG. 2, the user is asked to enter the final counter value after each set. At the end of the day, the program displays a screen showing the total number of reps and the calories expended.

Figure 5:
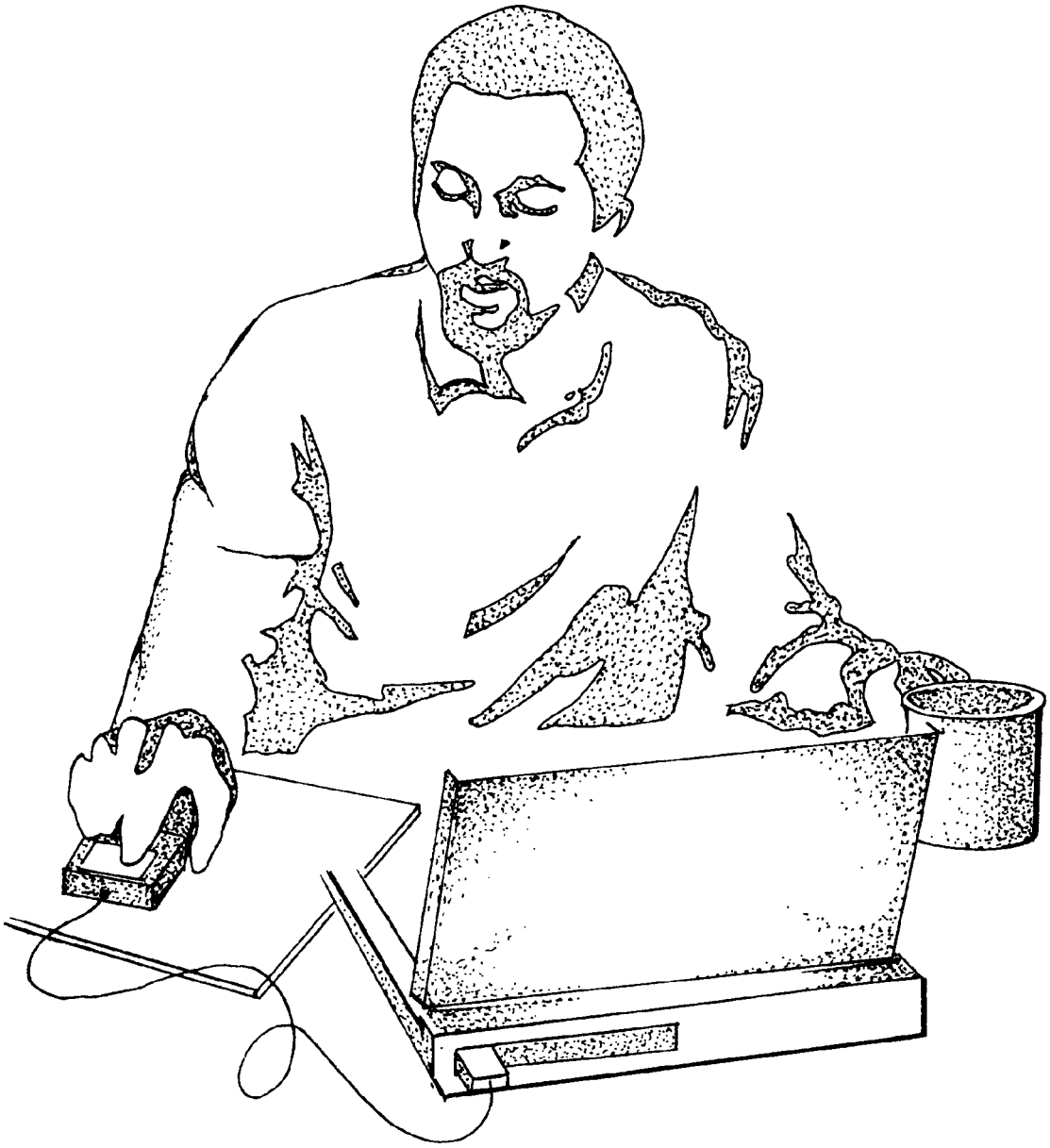
FIG. 5 is a computer mouse that incorporates a pulse rate sensor.
Figure 6:
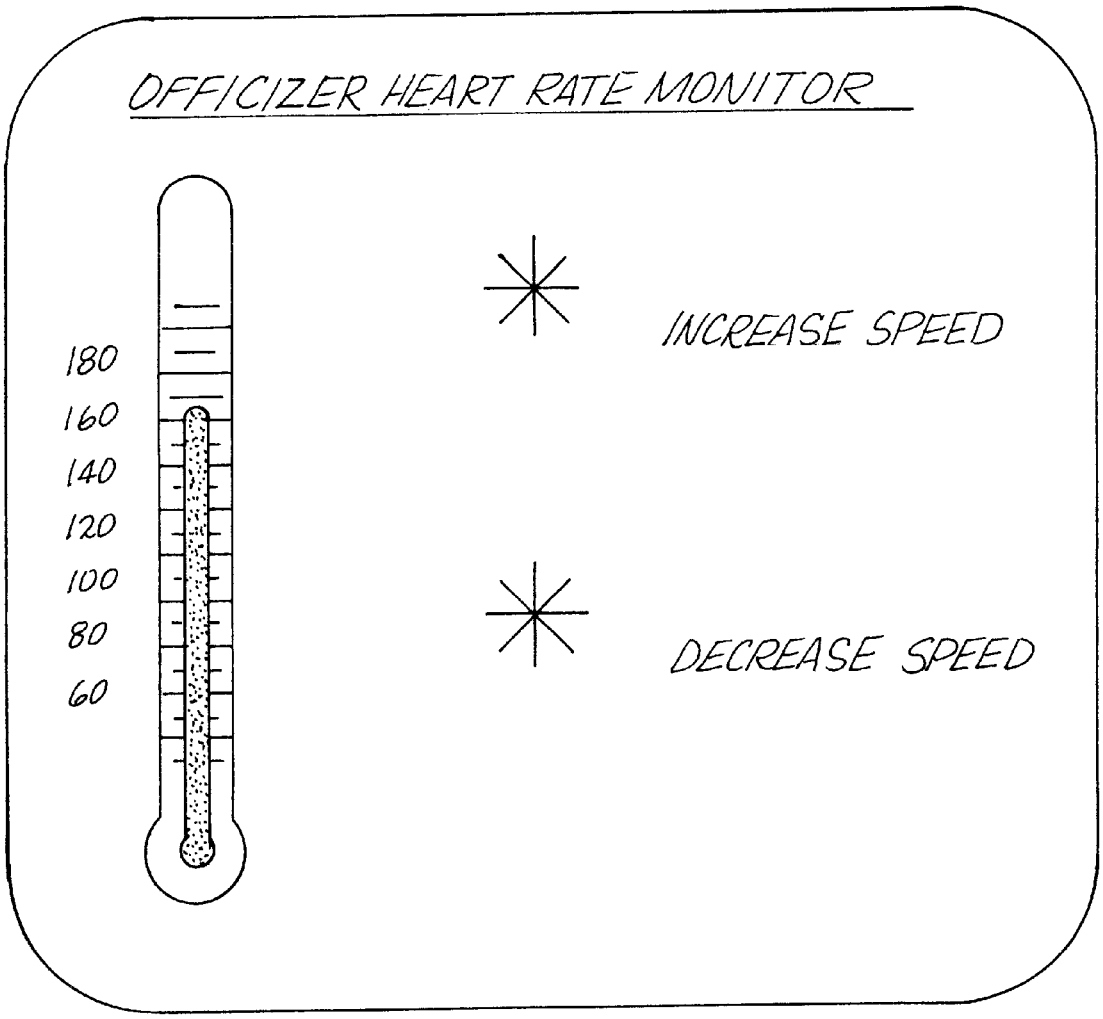
FIG. 6 is a typical computer screen for displaying the pulse rate sensed by the mouse in FIG. 5.

In an alternate embodiment, the user is also provided with a pulse sensor, which may be in the form of a conventional ear or finger clip. Alternatively, the pulse sensor may be incorporated into a mouse (see FIG. 5), which is equipped with a finger surface area containing an IR emitter/detector such as is used in pulse sensor watches made by, for example, Casio. The pulse sensor (and related electronics) is connected to a serial port of the computer, which can also supply operating power (or optional battery power can be used). The program periodically monitors the serial port to determine pulse rate, which is displayed graphically as shown in FIG. 6. The pulse rate is compared to the target rate, and an instruction is flashed on the screen to either increase or decrease exercise speed to maintain the target rate.

More exotic versions are also contemplated, where the counter information is automatically provided to the computer using an RF link between the counter and a serial port connected RF receiver.

What is claimed is:

1. Exercise apparatus for attachment to a chair having a center support post, the apparatus comprising:

a foot support having first and second ends;

resilient means for introducing resistance as the foot support is moved back and forth;

wheels mounted on the respective ends of the foot support for rolling on a floor;

a computer monitor;

means coupled to the wheels for monitoring a user's body functions during exercise; and means coupled to the monitoring means for displaying the user's exercise level on the computer monitor.

2. The exercise apparatus of claim 1 in which the computer monitor is part of a PC used by an office worker.

3. The apparatus of claim 2 in which the PC is programmed to accept time intervals at which a reminder screen is displayed on the computer monitor.

4. The apparatus of claim 3 in which the PC is programmed to calcualte the maximum heart rate.

5. The apparatus of claim 4 in which the PC is programmed to calculdate a target heart rate.

6. The appratus of claim 2 in which the PC is programmed to operate in the background.

7. The apparatus of claim 1 in which the monitoring means comprises means for counting the number of revolutions of the wheels.

* * * * *

UNITED STATES PATENT AND TRADEMARK OFFICE

CERTIFICATE OF CORRECTION

PATENT NO. : 6,010,430
DATED : January 4, 2000
INVENTOR(S) : Roy J. Mankovitz

It is certified that error appears in the above-identified patent and that said Letters Patent is hereby corrected as shown below:

Title page,
Item [76], Inventor should read: -- Roy J. Mankovitz, 18057 Medley Dr., Encino, CA (US) --.

Column 1,
Line 15, replace "invenention" with -- invention --.
Line 18, replace "resistance e as" with -- resistance as --.
Line 22, replace "BRIEF DESCRIPTION OF THE INVENTION" with -- BRIEF DESCRIPTION OF THE DRAWINGS --.
Line 25, replace "caarrying" with -- carrying --.
Line 35, between "FIG. 6 … by the mouse in FIG. 5." and the paragraph beginning with "In any exercise" insert the heading -- DETAILED DESCRIPTION OF THE INVENTION --.
Line 38, replace "incorporate" with -- incorporates --.

Column 2,
Line 58, replace "calculdate" with -- calculate --.

Signed and Sealed this

Third Day of December, 2002

JAMES E. ROGAN
*Director of the United States Patent and Trademark Office*